US005345368A

United States Patent [19]

Huff

[11] Patent Number: 5,345,368

[45] Date of Patent: Sep. 6, 1994

[54] HAND MOUNTED ILLUMINATING DEVICE

[76] Inventor: Thomas L. Huff, 1601 E. I St., McCook, Nebr. 69001

[21] Appl. No.: 105,170

[22] Filed: Aug. 12, 1993

[51] Int. Cl.[5] ..... F21L 15/08

[52] U.S. Cl. ..... 362/103; 362/191; 362/396; 2/160

[58] Field of Search ..... 362/103, 105, 191, 382, 362/396; 2/160

[56] References Cited

U.S. PATENT DOCUMENTS

| | | | |
|---|---|---|---|
| 1,015,715 | 1/1912 | Schindler | 362/103 |
| 1,769,241 | 7/1930 | Stephani | 362/103 |
| 3,638,011 | 1/1972 | Bain et al. | 362/103 |
| 4,625,339 | 12/1986 | Peters | 2/160 |
| 4,788,631 | 11/1988 | Fuller | 362/103 |
| 4,970,631 | 11/1990 | Marshall | 362/191 |
| 5,003,637 | 4/1991 | Lonon | 2/160 |
| 5,124,892 | 6/1992 | Lambert | 362/103 |
| 5,154,506 | 10/1992 | Leard | 362/103 |

FOREIGN PATENT DOCUMENTS

| | | | |
|---|---|---|---|
| 225557 | 1/1963 | Austria | 362/103 |
| 110611 | 10/1917 | United Kingdom | 362/103 |
| 1016632 | 11/1965 | United Kingdom | 362/103 |

*Primary Examiner*—Ira S. Lazarus
*Assistant Examiner*—Sara Sachie Raab
*Attorney, Agent, or Firm*—Dowell & Dowell

[57] ABSTRACT

A hand mounted illuminating device which includes a hand covering portion having a first fastening material and a strap which is moveable with respect thereto, and a flashlight including a second fastening material which is interengageable with the first fastening material after which the flashlight is selectively covered by the strap so as to secure the flashlight to the hand covering portion.

13 Claims, 3 Drawing Sheets

Fig. 1
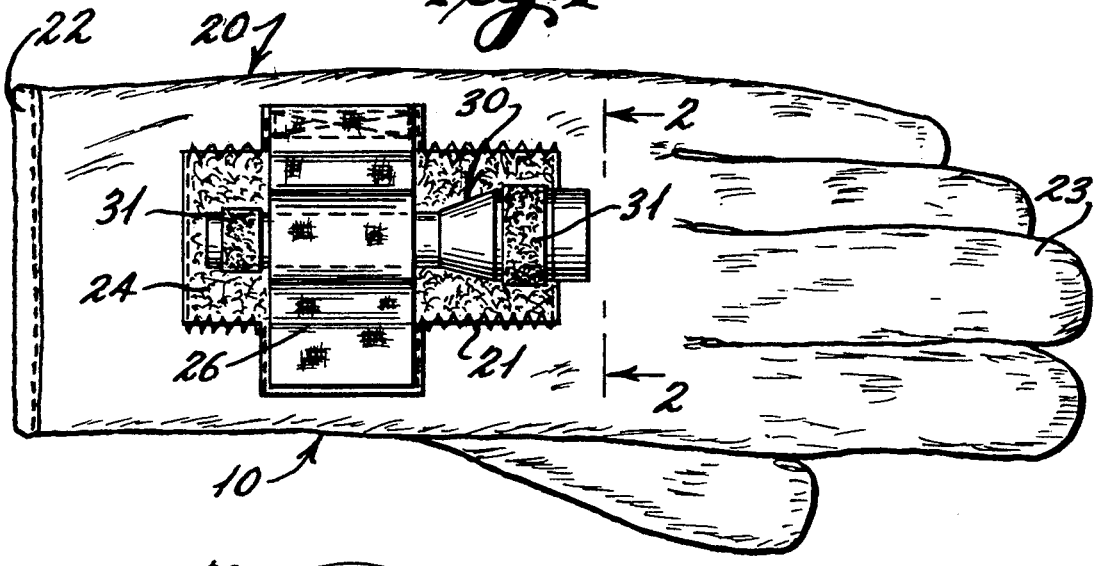
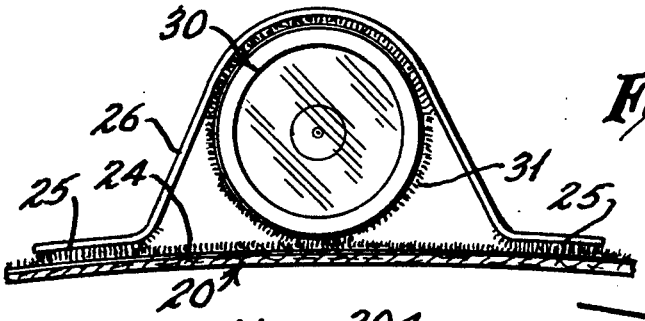
Fig. 2
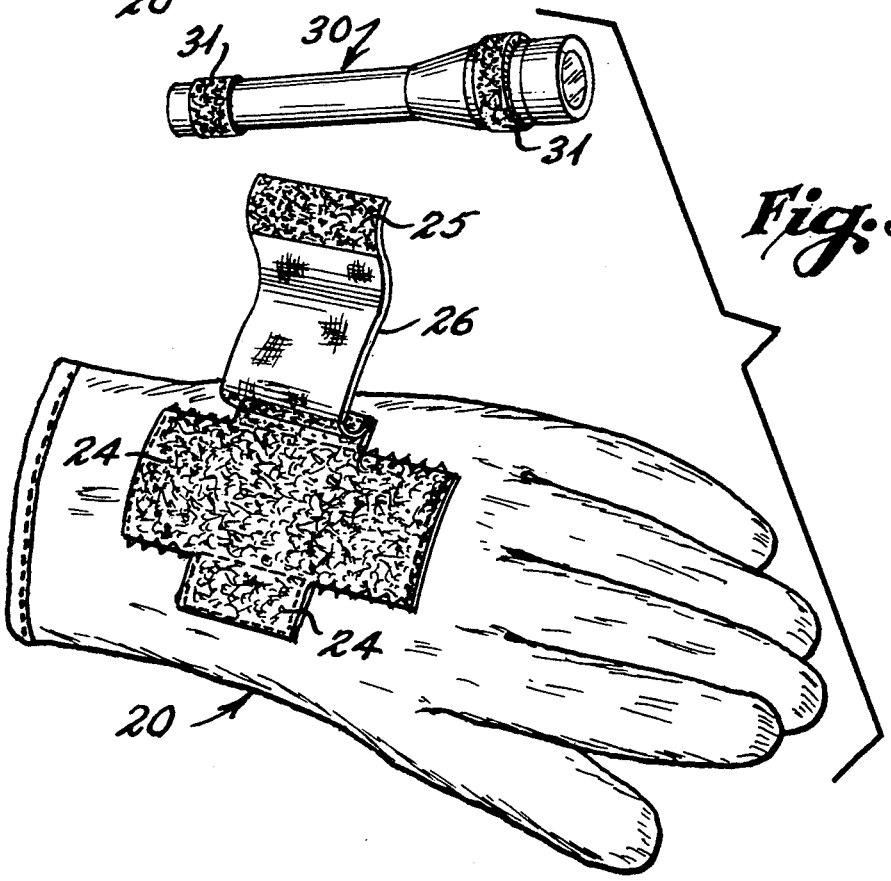
Fig. 3

HAND MOUNTED ILLUMINATING DEVICE

BACKGROUND OF THE INVENTION

1. Field of the Invention

This invention relates to an illuminating device, and, more particularly, to a hand mounted illuminating device which comprises a hand covering portion and a securely attachable flashlight.

2. Discussion of the Related Art

In numerous situations, it is necessary for persons working in unlit rooms or outdoors at nighttime to require a lighting device such as a flashlight while at the same time needing to use their hands for some other purpose. For example, railroad employees oftentimes require lighting when performing various outdoor duties such as lubricating and maintaining equipment, unhitching cars or setting switches in unlighted areas. Security guards frequently must enter dark areas in order to make security checks of locks and the like. Persons practicing outdoors sporting activities at nighttime also are handicapped without a source of illumination to guide them. Fishermen having to bait hooks or unhook caught fish must be able to see at least for safety purposes. Many other related examples can be described.

Furthermore, even if a lighting device is available in situations like the above, it is of limited usefulness if the illuminating device is not designed so that the person can simultaneously perform the activity and control the light to ensure that the exact location is illuminated. Thus, illuminating devices which must be grasped by the user's hands, or devices which inhibit movement of the hands, are, in many situations, of little utility.

A number of lighting devices have been developed that are directed to the above-described problems. For example, wrist mounted illuminating devices have been known as exemplified by U.S. Pat. Nos. 1,769,241 to Stephani; 4,788,631 to Fuller and 5,154,506 to Leard. A finger mounted illuminating device is disclosed in U.S. Pat. No. 5,124,892 to LandPert. Finally, glove mounted illuminating devices have been disclosed in the prior art as exemplified by U.S. Pat. Nos. 1,015,715 to Schindler; 3,638,011 to Bain et al. and 4,625,339 to Peters.

The above-described glove mounted lighting devices have been inadequate, however, because no single device has provided the following combination of advantages: interchangeability of various lighting devices; secure attachment, yet easy detachment, of the flashlight relative to the device; and essentially no inhibition of movement of the user's hand on which the illuminating device is worn. Thus, there has been a need for such an improved hand mounted illuminating device which exhibits each of these advantages.

SUMMARY OF THE INVENTION

The present invention has been made in view of the abovedescribed inadequacies of the related art and has as an object to provide a hand mounted illuminating device which includes a hand covering portion and an attachable flashlight.

It is another object of the present invention to provide a hand mounted illuminating device in which the flashlight is securely attachable to the hand covering portion, yet readily detachable therefrom by the user.

It is yet another object of the present invention to provide a hand mounted illuminating device which exposes a portion of the user's hand so that the user is better able to grasp and control an object.

It is a further object of the present invention to provide a hand mounted illuminating device which includes a portable flashlight and wherein positioning of the flashlight will not be changed during movement of a user's hand.

Additional objects and advantages of the present invention will become apparent from the detailed description which follows, considered in conjunction with the accompanying drawing figures.

To achieve the objects of the invention, as embodied and broadly described herein, the hand mounted illuminating device of the present invention includes a hand covering portion including a first fastening material, a flashlight including a second fastening material which is interengageable with the first fastening material, and wherein a strap is positionable over the flashlight and engageable with the first fastening material so as to secure the flashlight to the hand covering portion.

BRIEF DESCRIPTION OF THE DRAWINGS

In the accompanying drawings:

FIG. 1 is a top plan view of an embodiment of a hand mounted illuminating device in accordance with the present invention;

FIG. 2 is an enlarged partial cross-sectional view taken in the direction of line 2—2 of FIG. 1;

FIG. 3 is an illustrational view of the hand mounted illuminating device shown in FIG. 1 illustrating detachment of the flashlight from the glove;

DETAILED DESCRIPTION OF THE PREFERRED EMBODIMENTS

Figure 4:
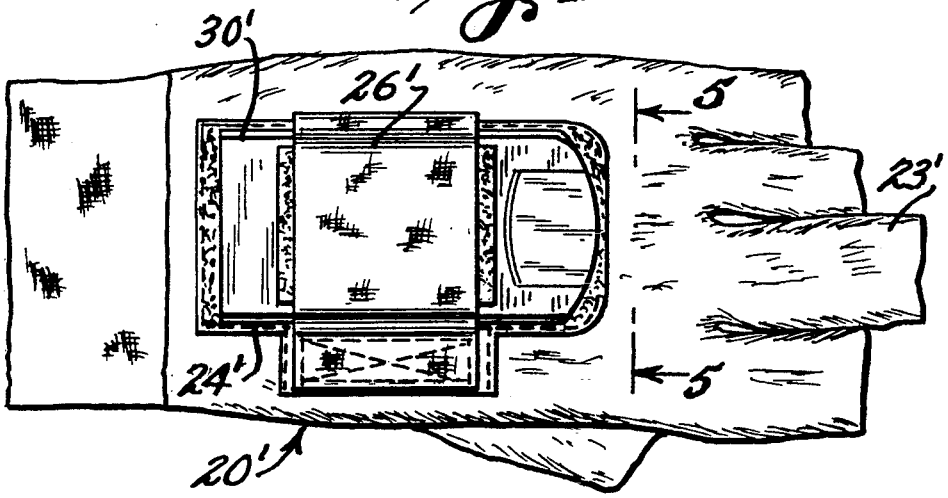
FIG. 4 is a top plan view of another embodiment of a hand mounted illuminating device in accordance with the present invention.

The invention will now be described in detail with reference to the drawing figures.

FIGS. 1–3 illustrate a hand mounted illuminating device 10 in accordance with a preferred embodiment of the present invention. The illuminating device includes a hand covering 20, which is a glove in the illustrated embodiment. The glove includes a first fastening material 21 attached to its top surface intermediate the back end 22 and the tips of the finger receiving portions 23. The first fastening material preferably comprises a hook and loop type fastening material such as "VELCRO" TM. As illustrated, the loop element 24 of the first fastening material is attached directly to the upper surface of the glove, and the hook element 25 is located on the inner face of a strap 26 at opposite ends thereof.

The strap overlies the loop element 24 as shown in FIG. 1 and is preferably completely separable therefrom. The strap may optionally include a hook element at only one end and be fastened at the other end to an associated end of the loop element by stitches or the like (not shown), so as to form a hinged connection between the two elements.

In accordance with the present invention, the locations of the hook and loop elements may be reversed with respect to each other so that a hook element can be attached directly to the top surface of the glove and at least one loop element attached to the strap.

The hand mounted illuminating device further comprises a flashlight 30 which is removably attachable to the glove. The flashlight has a second fastening material 31 attached at one or more spaced locations along its length. The flashlight is preferably a penlight type having a generally elongated configuration as best shown in FIG. 3. It may optionally be any lightweight, battery powered type of flashlight so long as it is comfortable to wear and does not inhibit the user's ability to move his or her hand.

The illustrated second fastening material 31 comprises the hook element of a hook and loop type fastening material. The loop element may optionally be attached to the flashlight in those instances when the hook element of the first fastening material is attached to the glove.

In use, the flashlight is secured to the glove by interengagement of the respective hook elements 31 and loop elements 24. To further secure the flashlight to the glove, the strap 26 is placed over the flashlight and fastened to the loop element 24 by interengagement with the hook element 25. In this condition, the flashlight is securely retained against undesired movement with respect to the glove. Yet at the same time, the flashlight is easily removable from the glove by disconnecting the strap from the flashlight and therefore disengaging the flashlight from the glove. The strap may thereafter be replaced and the glove used in a conventional manner.

Figure 5:
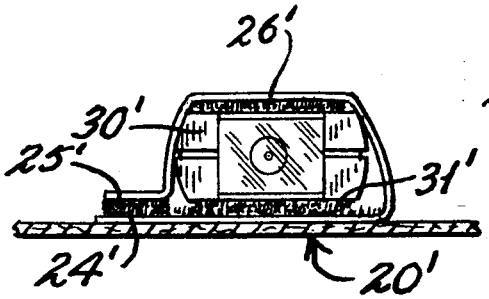
FIG. 5 is a cross-sectional view taken in the direction of line 5—5 of FIG. 4.
Figure 6:
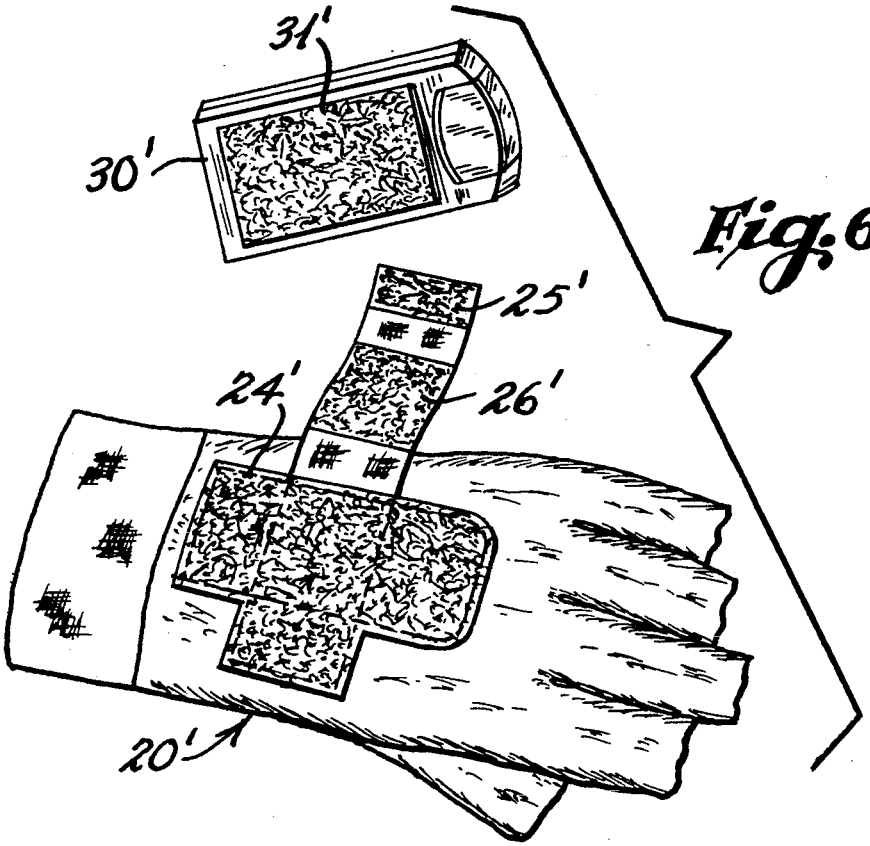
FIG. 6 is an illustrational view of the hand mounted illuminating device shown in FIG. 4 illustrating detachment of the flashlight from the glove.

FIGS. 4–6 illustrate a hand mounted illuminating device in accordance with another embodiment of the present invention. In this embodiment, a glove 20' includes finger receiving portions 23' each having an open end through which the fingers of the user extend. These open ends enable the user's fingers to directly contact a surface and thus allow enhanced control of a grasped object.

The illustrated flashlight 30' has a generally rectangular shape and includes a second fastening material 31' attached to at least one side thereof. The second fastening material is a hook element of a hook and loop type fastening material. In use of the illuminating device shown in FIGS. 4 and 5, this hook element interengages a loop element 24' attached to the glove to securely fasten the flashlight to the glove. Thereafter, the strap 26' is placed over the flashlight 30' and the fastening material 25' engaged with the fastening material 24' on the glove, as shown in FIGS. 4 and 5.

FIGS. 7–10 illustrate another embodiment of a hand mounted illuminating device in accordance with the present invention. As shown, the hand covering means 40 includes a generally rectangular shaped covering portion 41 which is positionable on the upper surface on back of a user's hands. The covering portion is fastened at a fixed position by pairs of elastic, self-adjustable end straps 42 and 43 connected to opposite ends of the covering portion. The hand covering also includes a central strap 47 located intermediate to the end straps for securing a flashlight 50 to the covering portion.

Figure 7:
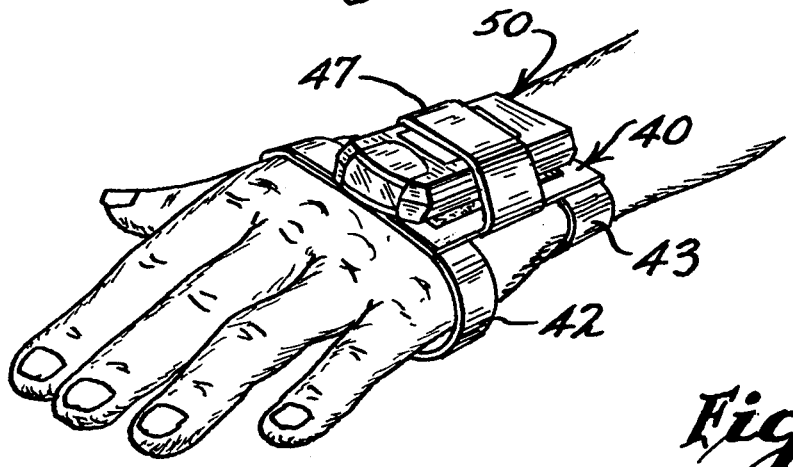
FIG. 7 is a top perspective view of another embodiment of a hand mounted illuminating device in accordance with the present invention.
Figure 8:
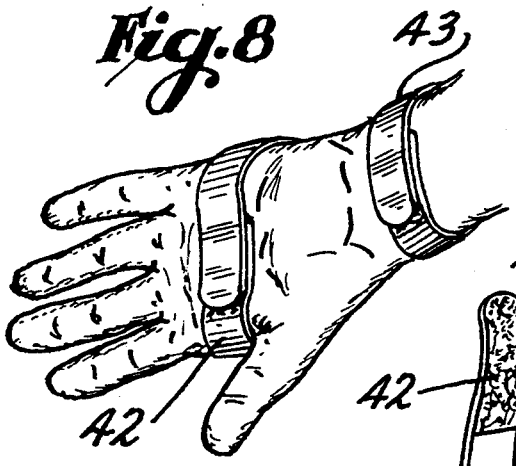
FIG. 8 is a bottom perspective view of the illuminating device shown in FIG. 7 illustrating both straps in the fastened condition.
Figure 9:
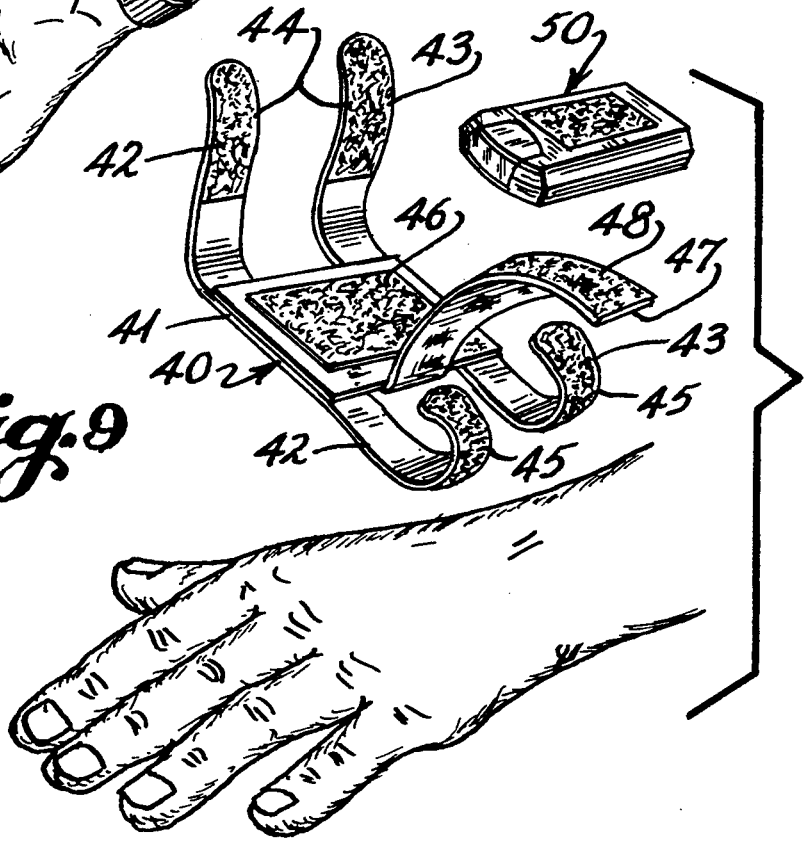
FIG. 9 is an illustrational view of the illuminating device illustrated in FIG. 7.

Straps 42 are positionable about the user's hand adjacent to the knuckles, and straps 43 are positionable about the wrist, as depicted in FIGS. 7 and 8. These straps each preferably include interengageable hook and loop fastening elements to affix them on the hand and wrist. As illustrated in FIG. 9, one of the straps 42 includes one of a hook or loop element 44 at one end thereof, and the other strap 42 includes fastening element 45 at the end thereof for engagement with element 44. Likewise, one of the straps 43 includes hook and loop fastening material element 44 at its end while the other strap 43 has fastening material 45 at its end. FIG. 8 illustrates the straps 42 and 43 in the use condition in which the elements 44 and 45 are interengaged.

The covering portion 41 includes either of a hook or loop fastening material element 46 attached to its upper surface. The strap 47 is connected to the covering portion 41 at one edge thereof and includes a hook or loop fastening material element 48 attached to its interior face at its free end. The element 48 is provided to interengage the element 46 fastened to the covering portion 41 when the device is in use as shown in FIG. 7.

Figure 10:
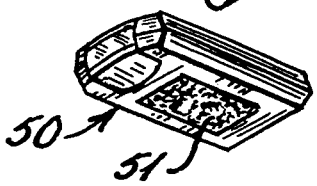
FIG. 10 is a bottom perspective view of the flashlight shown in FIG. 9 illustrating fastening material located on a second side of the flashlight.

The flashlight depicted in the embodiment of FIGS. 7–10 is of the same type shown in FIG. 6. Other types of flashlights such as the penlight flashlight shown in FIG. 3 may optionally be used in this embodiment. The flashlight 50 includes hook or loop fastening material elements 51 and 52 on opposite faces as shown in FIGS. 9 and 10. The element 52 interengages the element 48 on central strap 47 and the element 51 interengages the fastening material element 46 on the covering portion 41 when the illuminating device is being worn. The respective fastening materials assure secure attachment of the flashlight to the covering portion, yet enable the flashlight to be easily removed. The additional security provided by engaging the fastening material on the strap 47 with the material 46 in the covering may also be used in the previously discussed embodiments.

When the illuminating device of this embodiment is in use, the lower side of the hand is exposed except for that region covered by straps 42 and 43, as shown in FIG. 8. In addition, the user's fingers are entirely exposed. Consequently, the user's ability to grasp an object is improved.

From the foregoing description, the hand mounted illuminating device in accordance with the present invention provides a previously unavailable combination of advantages. Namely, it provides interchangeability of various lighting devices; secure attachment of the flashlight regardless of hand movement and yet easy detachment, of the flashlight with respect to the device; and essentially no inhibition of movement of the user's hand on which the illuminating device is worn.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A hand mounted illuminating device, comprising:

covering means for placing on a user's hand including an upper portion for overlaying the back of the hand, a first fastening material mounted to said upper portion;

a flashlight having a generally cylindrical housing, a second fastening material attached to said housing being engageable with said first fastening material so as to secure said flashlight to said covering means; and a strap mounted to said upper portion of said covering means, said strap having a central portion, a second fastening material mounted to said strap for selectively engaging said first fastening material, and a first fastening material attached to said central portion for selectively engaging a portion of said second fastening material attached to said housing.

2. The illuminating device of claim 1, wherein said first and second fastening materials are hook and loop fastening materials.

3. The illuminating device of claim 1, wherein said strap is separable from said covering means.

4. The illuminating device of claim 1, wherein said covering means comprises a glove including a plurality of finger receiving portions.

5. The illuminating device of claim 4, wherein said finger receiving portions each have an open end.

6. The illuminating device of claim 1, including at least two spaced second fastening materials secured to said housing and being engageable with said first fastening material.

7. A hand mounted illuminating device, comprising:

covering means for placing on a user's hand including an upper portion for overlaying the back of the hand, a first fastening material mounted to said upper portion;

a flashlight including a housing having upper and lower surfaces, a second fastening material secured to said lower surface being engageable with said first fastening material so as to secure said flashlight to said covering means; and a strap mounted to said upper portion of said covering means, and second fastening material mounted to said strap for selectively engaging said first fastening material.

8. The illuminating device of claim 7, wherein second fastening material is secured to said upper surface, said strap includes a central portion having first fastening material secured thereto for selectively engaging a portion of said second fastening material secured to said upper surface of said flashlight.

9. The illuminating device of claim 7, wherein said covering means comprises a glove including a plurality of finger receiving portions.

10. The illuminating device of claim 9, wherein said finger receiving portions each have an open end.

11. A hand mounted illuminating device, comprising:

covering means for covering a portion of a user's hand including an upper portion for overlaying the back of the hand, a first end strap located at one end thereof being positionable about the user's hand, a second end strap located at an opposite end thereof being positionable about the user's wrist, and a first fastening material mounted to said upper portion; and a flashlight having a housing including upper and lower surfaces, and a second fastening material secured to said lower surface being engageable with said first fastening material on said upper portion so as to secure said flashlight to said covering means.

12. The illuminating device of claim 11, wherein said second fastening material is secured to said upper surface of said flashlight, said covering means includes a central portion having first fastening material secured thereto for selectively engaging a portion of said second fastening material mounted to said flashlight.

13. The illuminating device of claim 12, wherein said first and second end straps each include a hook and loop type fastening material.

* * * * *